US006829989B2

(12) United States Patent
Chudy

(10) Patent No.: US 6,829,989 B2
(45) Date of Patent: Dec. 14, 2004

(54) APPARATUS AND METHOD FOR MARKING A GOLF BALL

(75) Inventor: Dean Chudy, Wadsworth, IL (US)

(73) Assignee: Golf Gifts & Gallery Inc., Powers Lake, WI (US)

( * ) Notice: Subject to any disclaimer, the term of this patent is extended or adjusted under 35 U.S.C. 154(b) by 0 days.

(21) Appl. No.: 10/349,154

(22) Filed: Jan. 22, 2003

(65) Prior Publication Data

US 2004/0139867 A1 Jul. 22, 2004

(51) Int. Cl.[7] ..... B41F 17/00
(52) U.S. Cl. ..... 101/35; 101/333; 101/DIG. 40
(58) Field of Search ..... 101/35, 103, 104, 101/327, 333, 334, DIG. 40

(56) References Cited

U.S. PATENT DOCUMENTS

| | | | | |
|---|---|---|---|---|
| 849,600 A | | 4/1907 | Cory | |
| 943,851 A | | 12/1909 | West | |
| 1,281,063 A | | 10/1918 | Pearson | |
| 1,537,685 A | | 5/1925 | Ladd | |
| 1,594,431 A | * | 8/1926 | Thomson | 101/41 |
| 1,814,170 A | | 7/1931 | Long | |
| 2,561,947 A | | 7/1951 | Premo | |
| 3,282,200 A | | 11/1966 | Brandell | |
| 4,086,851 A | | 5/1978 | Brandell | |
| 4,163,421 A | | 8/1979 | Sihota | |
| 4,803,922 A | | 2/1989 | Dennesen | |
| 5,450,791 A | | 9/1995 | Prohm | |
| 5,743,180 A | | 4/1998 | Arnke | |
| 5,878,659 A | | 3/1999 | Hatter | |
| 5,980,624 A | | 11/1999 | Ichikawa | |
| 6,004,223 A | | 12/1999 | Newcomb | |
| 6,125,747 A | | 10/2000 | Elliott | |
| 6,209,452 B1 | | 4/2001 | Klimek | |

FOREIGN PATENT DOCUMENTS

JP 02128774 A * 5/1990 ..... A63B/45/02

* cited by examiner

*Primary Examiner*—Ren Yan
(74) *Attorney, Agent, or Firm*—Factor & Lake, Ltd.

(57) ABSTRACT

A golf ball marking device is provided comprising a first lever arm having a stamp, a second lever arm operably connected to the first lever arm and having a ball positioning member, and a movable ink pad operably connected to one of the first and second lever arms. The moveable ink pad is arranged to contact the stamp when the device is in an inking position. The stamp contacts a ball placed in the ball positioning member when the device is in a marking position. A method of pad printing a golf ball with a portable marking device that utilizes a permanent ink or a non-water soluble ink is also provided.

31 Claims, 3 Drawing Sheets

APPARATUS AND METHOD FOR MARKING A GOLF BALL

TECHNICAL FIELD

The invention relates to a marking device, and more particularly to a marking device and method for pad printing a golf ball with initials or other markings.

BACKGROUND OF THE INVENTION

Golf balls are generally identifiable by the make and model of the ball, and by a single digit number printed on the ball by the manufacturer. However, many players use the same make and model of golf ball, and inevitably, golf balls having the same single digit number. In addition, players may forget the make, model, or number of their ball during a round of golf. It is therefore desirable in the game of golf to provide a system for indisputably identifying golf balls with the proper owner. This will serve to eliminate disputes, disagreements, and unnecessary acrimony during the progress of the game, and to encourage diligence and honesty in caddies and golfers searching for golf balls.

Prior art golf ball marking devices have been lacking in many respects. One problem with certain prior art marking devices is they provide means for applying only a single type of mark. For example, a commonly used marking device includes an ink stamp which consists of three small circles arranged in a line. While placing any type of mark on a golf ball will lessen the chance for confusing one ball with another, it is still possible for multiple persons on the same golf course to have identically marked balls. In addition, if one person in a golf group has such a golf ball marking device, it cannot be used by all the members of the group to effectively differentiate one player's ball from another.

Another problem with prior art golf ball marking devices which utilize an ink stamp is the difficulty associated with inking the stamp. It is difficult to provide a uniform amount of ink to the entire stamp. It is also difficult to apply ink to the stamp without making a mess, or otherwise inadvertently having ink applied to a user's hands, clothing, or workspace.

Other prior art marking devices that utilize ink coated paper placed against a golf ball and stamped with indicia have also been found to be deficient. One problem with these types of golf ball marking devices is the amount of pressure that must be applied to the ink coated paper to transfer the ink to the golf ball. It is very difficult and uncomfortable for an average user to apply enough force to these types of devices to effectively transfer ink to the golf ball. In addition, the inks used with these types of devices often do not display good adhesion to the materials used in modern golf ball coverings.

The present invention is intended to overcome these and other problems associated with prior art golf ball marking devices.

SUMMARY OF THE INVENTION

A golf ball marking device is provided comprising a first lever arm having a stamp, a second lever arm operably connected to the first lever arm and having a ball positioning member, and a movable ink pad operably connected to one of the first and second lever arms. The moveable ink pad is arranged to contact the stamp when the device is in an inking position. The stamp contacts a ball placed in the ball positioning member when the device is in a marking position.

According to another aspect, a method of pad printing a golf ball with a portable marking device that utilizes a permanent ink is provided. The method comprises the steps of applying a permanent ink to an ink pad of the device, drawing the ink pad into contact with an ink stamp of the device; and drawing the ink stamp into contact with a golf ball to transfer the permanent ink thereto.

These and other aspects will become apparent from a review of the Drawings, Detailed Description, and the Claims.

DETAILED DESCRIPTION OF THE PREFERRED EMBODIMENTS

While the present invention will be described fully hereinafter with reference to the accompanying drawings in which a particular embodiment is shown, it is to be understood at the outset that persons skilled in the art may modify the invention herein described while staying within the spirit and scope of the invention to achieve the desired results. Accordingly, the description which follows is to be understood as an informative disclosure of a specific embodiment under the invention directed to the understanding of persons skilled in the appropriate arts, and not as a limitation of the scope of the present invention.

Figure 1:
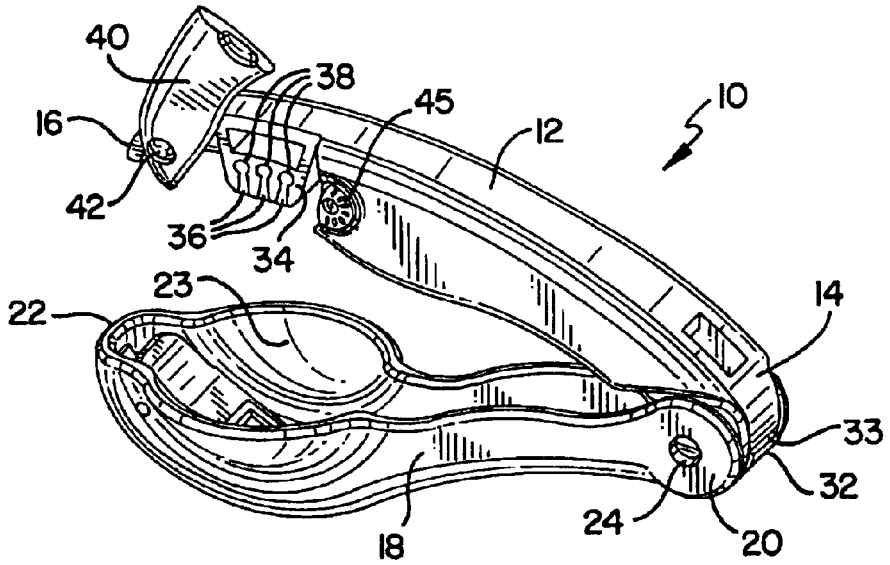
FIG. 1 is a perspective view of a preferred embodiment of a golf ball marking device in accordance with a particular aspect of the present invention.
Figure 2:
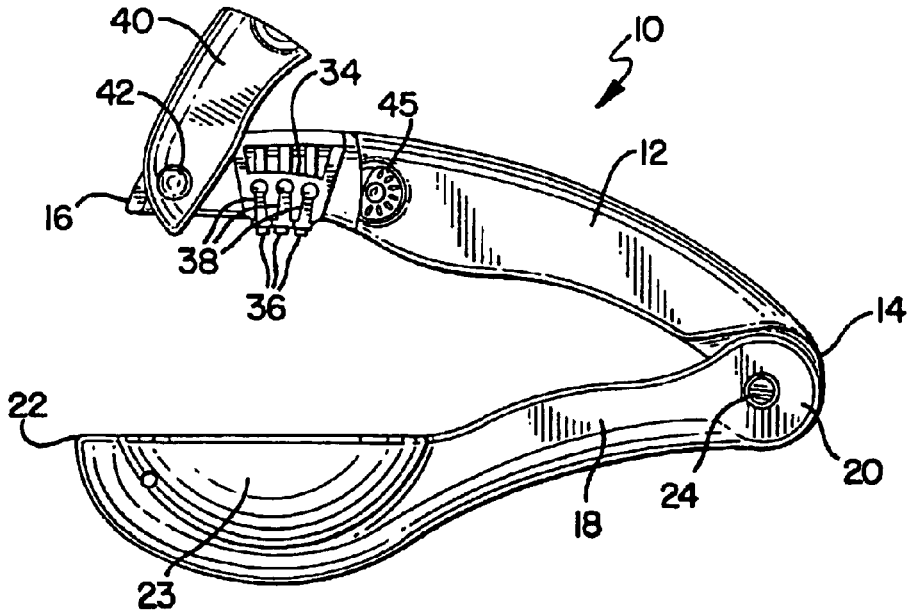
FIG. 2 is a side elevational view of the golf ball marking device of FIG. 1.

Referring to FIGS. 1 and 2, a preferred embodiment of a golf ball marking device in accordance with the present invention is shown as reference numeral 10. The device 10 includes a first lever arm 12 having a first end 14 and a second end 16. The device 10 further includes a second lever arm 18 having a first end 20 and a second end 22. A generally hemispherically-shaped golf ball positioning member 23 is disposed generally at the second end 22 of the second lever arm 18. The ball positioning member 23 is preferably sized to accommodate a standard sized golf ball. The first lever arm 12 and second lever arm 18 are pivotably joined proximate to the first ends 14,20 at a pivoting joint 24.

Figure 3:
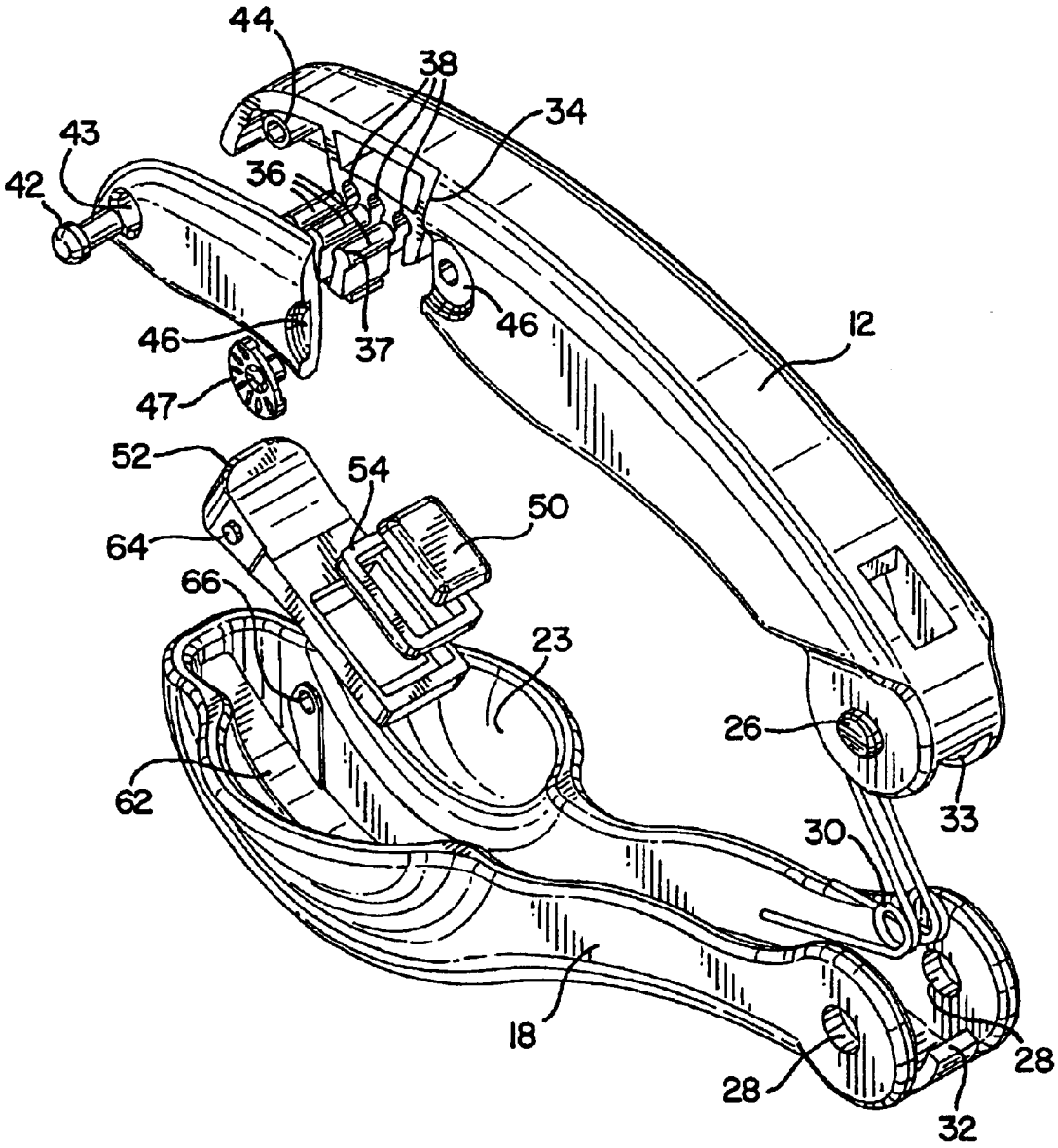
FIG. 3 is an exploded assembly view of the golf ball marking device of FIG. 1.

In a preferred embodiment, the pivoting joint 24 generally includes a pair of pins 26 disposed on the first lever arm 12, as best shown in FIG. 3 (only one of the pair of pins 26 is shown in FIG. 3 with the understanding that the other pin 26 is disposed on an opposite side of the lever arm 12). Each of the pins 26 are adapted to be disposed within one of a pair of apertures 28 in the second lever arm 18. The combination of the pins 26 and the apertures 28 define the pivoting joint 24 shown in FIGS. 1 and 2 and allow the first and second lever arms 12,18 to pivot with respect to one another. Other pivoting connections between the first and second lever arms 12,18 could also be implemented without departing from the invention, such as a hinge, socket joint, or the like. As shown in FIG. 3, a spring 30 is disposed between the lever arms 12,18, which forces the lever arms 12,18 apart, and a stop 32 is provided on the second lever arm 18 to limit separation of the lever arms 12,18. The spring 30 biases the lever arms 12,18 into a neutral position wherein the device is open and the stop 32 engages a stop surface 33 disposed on the first lever arm 12, as shown in FIG. 1. The neutral position of the device 10 is depicted in FIGS. 1 and 2. The neutral position provides sufficient separation between the lever arms 12,18 to allow insertion of a golf ball into the golf ball positioning member 23 of the device 10, while still allowing both lever arms 12,18 to be easily grasped and closed by a user's hand.

As shown in FIGS. 1–3, the first lever arm 12 includes a stamp 34, which preferably includes individual stamp pieces 36. Each of the stamp pieces 36 includes a raised surface defining indicia, such as a letter or other symbol. As best shown in FIG. 3, each of the stamp pieces 36 further includes a keyed portion 37, which has a shape that is keyed to a shape of one of a plurality of slots 38 in the first lever arm 12 to hold the pieces securely in place. The stamp pieces 36 are preferably a rubber or other elastomeric material suitable for pad printing. The stamp pieces 36 are removably disposed within the slots 38 and their positions can be interchanged with other stamp pieces. Preferably, the device 10 includes three slots 38 to accommodate three stamp pieces 36, which correspond to three letters of an individual's initials. However, it is possible that any number of slots could be included in different embodiments with the same beneficial results. Alternatively, a one-piece stamp could be used which includes a raised surface in the form of indicia, such as letters, a word, or design. In this alternative, the stamp may be either permanently affixed or removable.

Figure 4:
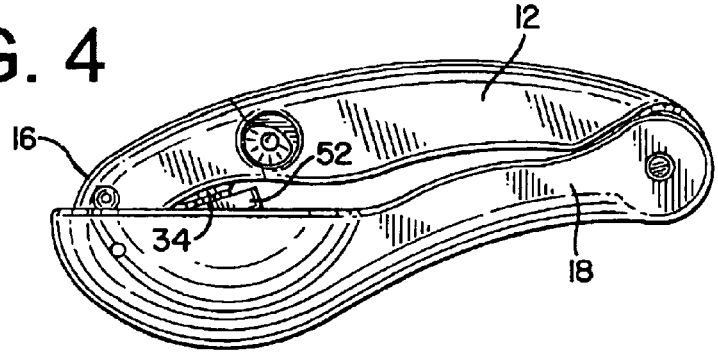
FIG. 4 is a side elevational view of the golf ball marking device of FIG. 1 shown in an inking position.

As shown in FIGS. 1 and 2, the slots 38 and corresponding stamp pieces 36 are preferably covered by a cover 40 to secure them in the device 10. As shown in FIG. 3, the cover 40 is pivotably mounted to the first lever arm 12 by a pin 42 inserted through an aperture 43 in the cover 40 and into a blind-hole 44 formed within the first lever arm 12. Referring to FIG. 2, a locking mechanism 45 is disposed adjacent to the cover 40 to hold the cover securely in place. Referring again to FIG. 3, the locking mechanism 45 includes a circular recess 46 formed in the first lever arm 12 and a portion of the cover 40. The locking mechanism 45 also includes a locking tab 47 that is rotationally mounted within the recess 46 and rotatable such that it is capable of being disposed within an extent of the portion of the recess 44 formed in the cover 40, thereby defining a locked position, as shown in FIG. 4. To unlock the cover, the tab 47 is rotated so it does not cover any portion of the recess 46 in the cover 40, thereby allowing the cover 40 to pivot to an open position, as shown in FIGS. 1 and 2.

Referring again to FIG. 3, the device 10 includes an ink pad 50 and an ink pad positioning member 52. The ink pad 50 is held in place on the positioning member 52 by a frame 58, as shown in FIG. 3. The ink pad 50 is preferably a sponge-like material which absorbs and holds ink and keeps it from drying. Ink is preferably transferred to the ink pad 50 by placing drops of ink thereon from an ink bottle. As shown in FIG. 3, the ink pad positioning member 52 is pivotably mounted within a channel 62 in the second lever arm 18. A pair of pins 64 extend from the positioning member 52 (only one pin 64 is shown on one side of the positioning member 52 in FIG. 3) and each pin is disposed within one of a pair of holes 66 within the channel 62 (only one hole 66 is shown on one side of the channel 62 in FIG. 3). The pin/recess arrangement is positioned such that it acts as a fulcrum about which the positioning member 52 can be pivoted within the channel 62.

Before initial use of the device 10 to mark a golf ball, and periodically thereafter, ink must be applied to the ink pad 50. The ink used is preferably a permanent ink, as defined by those of ordinary skill in the art of inks, having good marking characteristics for materials used to form golf ball covers. Golf ball covers are generally made from either naturally occurring materials, such as balata, or polymers, such as, for example, Surlyn®, manufactured by DuPont. A particular aspect of the invention lies in the use of a permanent ink on these types of covers, which have been difficult to mark with inks traditionally used in golf ball marking devices utilizing a stamp. The ink used with the device 10 is preferably a non-water soluble ink, such as an oil-based ink. A non-water-soluble oil-based ink has been found to offer excellent marking properties on golf balls having balata covers, and covers made from Surlyn® and other polymer materials. Such ink has excellent adhesion to all types of golf ball covers and provides excellent durability. For ease of use, the ink is preferably provided in an ink bottle having a dropper, which allows ink to be dispensed directly onto the ink pad 50.

Another aspect of the present invention is the use of a permanent ink in a portable pad printing or ink stamp type device such as, for example, the device 10. While permanent ink markings have been applied to golf ball covers by felt-tip markers or other pens, no known device has applied non-water soluble permanent ink to a golf ball cover by the use of a pad printing or ink stamp process, such as with an ink pad and stamp combination. To facilitate the use of a permanent ink in a pad printing process, the permanent ink is preferably an oil-based ink comprising at least one solvent, a solvent evaporation-inhibiting additive, at least one resin additive that is soluble in the solvent, and a colorant. However, other variations may be utilized which will still allow the permanent ink to be applied by a pad printing or ink stamp process. Preferably, the solvent has a relatively high penetrability against a surface of a golf ball and a high vapor pressure as compared with those of solvents used for conventional inks used in printing on golf balls. Therefore, when the ink is adhered to the golf ball surface, it can either adhere by drying after penetration, or adhere by evaporation and drying. The evaporation-inhibiting additive allows the ink to remain wet on the ink pad 50 for a sufficient period of time when used in an appropriate proportion to the other components of the ink. The amount of this evaporation-inhibiting additive can be adjusted to achieve appropriate drying and penetration of the ink on the golf ball surface while balancing the drying time on the pad 50. The resin additive primarily affects the strength of the print seal and controls the viscosity of the ink. Since the ink composition does not contain water soluble materials, the resulting print is durable and offers excellent water resistance, which is desirable for print on a golf ball surface.

When using the device 10, the desired stamp pieces 36 are selected and placed within the slots 38. The device 10 is preferably supplied with a set of stamp pieces 36 including at least one, and more preferably three copies, of each letter of the alphabet. To access the slots 38 to place the stamp pieces 36 therein, the cover 40 is pivoted until the slots 38 are exposed, as shown in FIGS. 1 and 2. The stamp pieces 36 may then be inserted into the three slots 38. Preferably, the stamp pieces placed into the three slots form the initials of a person's name.

Figure 5:
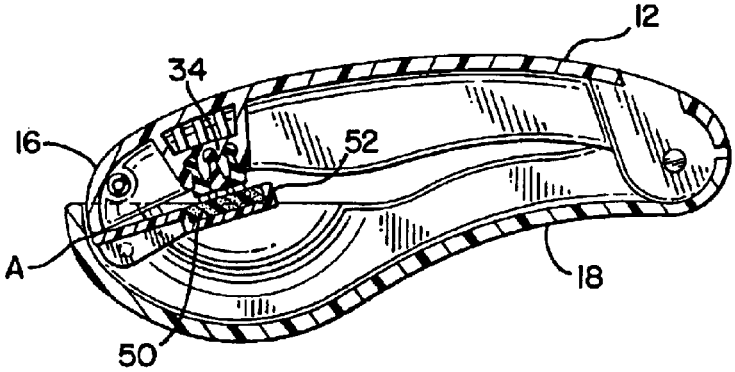
FIG. 5 is a cross-sectional view of the golf ball marking device as shown in FIG. 4.

The device 10 is placed into an inking position for transferring ink to the stamp pieces 36 of the stamp 34, as shown in FIGS. 4 and 5. In this position, the ink pad 50 and the stamp pieces 36 of the ink stamp 34 contact each other to allow transfer of ink to the stamp pieces 36. By drawing the first and second lever arms 12, 18 together, the second end 16 of the first lever arm 12 contacts ink pad positioning member 52 at point A as shown in FIG. 5. The first lever arm 12 applies a downward force to the positioning member 52 at point A and causes the positioning member 52 to pivot about the fulcrum defined by the combination of the pins 64 of the positioning member 52 and the recesses 66 within the channel 62. Since the ink pad 50 is positioned on the positioning member 52 at the opposing side of the fulcrum, it moves upward toward the ink stamp 34. The ink pad 50 is positioned on the ink pad positioning member 52 such that when it moves upward into the inking position, it comes into contact with the stamp 34. Ink is transferred from the ink pad 50 to the stamp 34 relative to the force applied to the lever arms 12,18.

Figure 6:
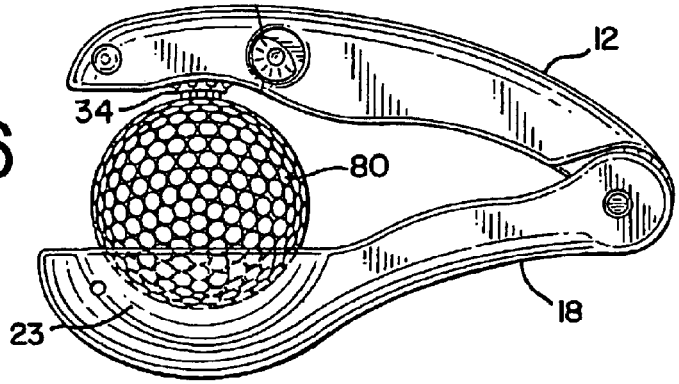
FIG. 6 is a side elevational view of the golf ball marking device of FIG. 1 shown in a marking position.
Figure 7:
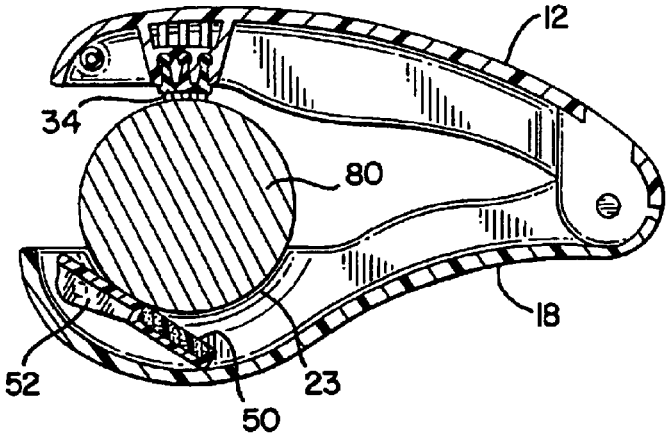
FIG. 7 is a cross-sectional view of the golf ball marking device as shown in FIG. 6.

After the device 10 has been placed in the inking position, a golf ball 80 is placed into the ball positioning member 23 and the device is placed into a marking position, as shown in FIGS. 6 and 7. The ball 80 rests in the ball positioning member 23, and may be rotated to expose the desired portion of the ball 80 to the stamp 34. By drawing the first and second lever arms 12,18 together, the ink stamp 34 comes into contact with the golf ball 80, thereby transferring ink to the golf ball 80 to apply the desired mark. After marking has been completed, the device 10 is allowed to return to the neutral position, wherein the golf ball 80 can be removed. Generally, after each golf ball is marked, the stamp 34 is preferably re-inked by placing the device 10 back into the inking position. However, the ink stamp 34 may contain enough residual ink to mark a second or third ball without requiring re-inking.

As best shown in FIG. 7, the ink pad 50 is disposed within the channel 62 of the second lever arm 18 when the device is not in the inking position, thereby defining a recessed position of the ink pad 50. The ink pad 50 is recessed sufficiently such that it does not contact the ball 80 when it is placed in the ball positioning member 23, as shown in FIG. 6. The ink pad positioning member 23 and ink pad 50 are also depicted in this recessed position in FIG. 8.

While specific embodiments have been illustrated and described, numerous modifications may come to mind without significantly departing from the spirit of the invention, and the scope of protection is only limited by the scope of the accompanying claims.

What is claimed is:

1. A golf ball marking device comprising:

a first lever arm having a stamp;

a second lever arm operably connected to the first lever arm and having a ball positioning member; and an ink pad movably and operably connected to one of the first and second lever arms and arranged to contact the stamp when the device is in an inking position;

wherein the stamp contacts a ball placed in the ball positioning member when the device is in a marking position.

2. The golf ball marking device of claim 1 wherein the stamp includes a plurality of stamp pieces held by the first lever arm.

3. The golf ball marking device of claim 2, wherein each of the stamp pieces include a raised indicia portion defining a letter of the alphabet.

4. The golf ball marking device of claim 3 wherein the first lever arm includes a plurality of slots into which the stamp pieces may be interchangeably held in place.

5. The golf ball marking device of claim 4 wherein the first lever arm includes a cover that covers the slots located therein and contains the stamp pieces within the slots.

6. The golf ball marking device of claim 1 further comprising a spring which biases the first and second lever arms away from each other in a neutral position.

7. The golf ball marking device of claim 1, wherein the ink pad contains a permanent ink that is transferred to the stamp in the inking position.

8. The golf ball marking device of claim 1 wherein the ball positioning member is generally hemispherically-shaped.

9. The golf ball marking device of claim 1 wherein the ink pad is connected to an ink pad positioning member operably connected to the second lever arm and wherein the ink pad moves toward the stamp when the first lever arm engages the ink pad positioning member.

10. The golf ball marking device of claim 1 further comprising an ink pad positioning member having an arm on which the ink pad is supported wherein the arm is pivotably mounted to the second lever arm.

11. The golf ball marking device of claim 10 wherein the second lever arm includes a channel into which the ink pad is disposed when the device is in a marking position.

12. The golf ball marking device of claim 1 wherein the first and second lever arms are joined to one another at a pivoting joint.

13. A golf ball marking device comprising:

a first lever arm having a stamp;

a second lever arm pivotally joined to the first lever arm;

an ink pad movably and operably connected to the second lever arm and arranged to move toward the stamp when engaged by the first lever arm and contacting the stamp in an inking position; and a ball positioning member for holding a ball such that the stamp contacts the ball when the device is in a marking position.

14. The golf ball marking device of claim 13, wherein the ink pad holds a permanent ink that is transferred to the stamp in the inking position.

15. The golf ball marking device of claim 14, wherein the permanent ink is non-water soluble.

16. The golf ball marking device of claim 14, wherein the permanent ink is an oil-based ink.

17. The golf ball marking device of claim 13 wherein the stamp includes a plurality of individual stamp pieces.

18. The golf ball marking device of claim 17 wherein the first lever arm includes a plurality of slots into which the stamp pieces may be interchangeably secured.

19. The golf ball marking device of claim 18 wherein the first lever arm includes a cover to provide access to the slots located therein when the cover is in an open position and to contain the stamp pieces within the slots when the cover is in a closed position.

20. The golf ball marking device of claim 13 wherein the ball positioning member is generally hemispherically-shaped.

21. The golf ball marking device of claim 13 wherein the ink pad is mounted to an ink pad positioning member that is pivotably mounted to the second lever arm and engageable by the first lever arm.

22. The golf ball marking device of claim 13 further comprising a spring that biases the first and second lever arms away from each other into a neutral position.

23. A golf ball marking device comprising:

a first lever arm having a stamp;

a second lever arm operably connected to the first lever arm and having a ball positioning member; and an ink pad movably and operably connected to the second lever arm;

the ink pad arranged to move into contact with the stamp when the first and second lever arms are moved into an inking position; and the stamp arranged to contact a ball placed in the ball positioning member when the first and second lever arms are moved into a marking position.

24. A golf ball marking device comprising:

a first lever arm having a stamp; and a second lever arm having an ink pad movably attached thereto and operably connected to the first lever arm;

wherein the ink pad moves toward and inks the stamp when the first and second lever arms are drawn toward each other and no ball is disposed therebetween; and wherein the stamp contacts a ball placed between the first and second lever arms when they are drawn toward each other.

25. A golf ball marking device comprising:

a first lever arm having a stamp;

a second lever arm having an ink pad movably attached thereto and operably connected to the first lever arm;

the ink pad carrying a permanent ink and adapted to contact the stamp when the device is in an inking position; and the stamp adapted to contact a ball placed between the lever arms when the device is in a marking position, the permanent ink thereby disposed on an outermost surface layer of the ball.

26. A golf ball marking device comprising:

a first lever arm having a stamp;

a second lever arm operably connected to the first lever arm and having a ball positioning member; and an ink pad carrying a permanent ink and movably and operably connected to one of the first and second lever arms, the ink pad arranged to contact the stamp when the device is in an inking position;

wherein the stamp contacts a ball placed in the ball positioning member when the device is in a marking position.

27. The marking device of claim 26, wherein the permanent ink is a non-water soluble ink.

28. The marking device of claim 26, wherein the permanent ink is an oil-based ink.

29. The marking device of claim 26, wherein the permanent ink is preferably an oil-based ink comprising at least one solvent, a solvent evaporation-inhibiting additive, at least one resin additive that is soluble in the solvent, and a colorant.

30. A golf ball marking device comprising:

a first lever arm;

a second lever arm pivotally joined to the first lever arm;

a stamp connected to one of the lever arms; and an ink pad movably and operably to the other of the lever arms;

wherein the ink pad moves toward and contacts the stamp when the lever arms are drawn together in an inking position; and wherein the stamp contacts a ball placed between the lever arms when they are drawn together in a marking position.

31. A golf ball marking device comprising:

a first lever arm having a stamp; and a second lever arm having an ink pad movably attached thereto and operably connected to the first lever arm;

the ink pad carrying a permanent ink that is water and wear resistant without a protective coating when applied to an outermost surface of a golf ball;

the ink pad contacting the stamp when the device is in an inking position, and the stamp contacting a ball placed between the lever arms when the device is in a marking position.

* * * * *